US007716778B2

(12) United States Patent
Meister

(10) Patent No.: US 7,716,778 B2
(45) Date of Patent: May 18, 2010

(54) BUFFING BALL

(76) Inventor: James J. Meister, 11390 Gideon La., Cincinnati, OH (US) 45249

( * ) Notice: Subject to any disclaimer, the term of this patent is extended or adjusted under 35 U.S.C. 154(b) by 106 days.

(21) Appl. No.: 12/100,518

(22) Filed: Apr. 10, 2008

(65) Prior Publication Data

US 2009/0258586 A1 Oct. 15, 2009

(51) Int. Cl.
*B24D 13/08* (2006.01)

(52) U.S. Cl. ..... 15/230.19; 15/230; 15/230.14; 15/230.16; 15/230.17; 15/230.18; 451/527; 451/529

(58) Field of Classification Search ..... 15/230, 15/230.14, 230.16, 230.17, 230.18, 230.19; 451/507, 508, 526, 527, 529, 464, 465
See application file for complete search history.

(56) References Cited

U.S. PATENT DOCUMENTS 1,799,808 A * 4/1931 Bartling ..... 15/230.16
1,819,800 A 8/1931 Turner
3,122,768 A 3/1964 Beumkes
3,417,420 A 12/1968 Rock
3,703,739 A 11/1972 Young et al.
4,199,835 A 4/1980 Heyer et al.
5,175,900 A 1/1993 Hadgis
6,223,383 B1 5/2001 VanPutten
7,203,989 B2 4/2007 McLain
2005/0120500 A1 * 6/2005 McLain ..... 15/230
2005/0188491 A1 9/2005 McLain

* cited by examiner

*Primary Examiner*—Mark Spisich
(74) *Attorney, Agent, or Firm*—Wood, Herron & Evans, L.L.P.

(57) ABSTRACT

A buffing ball is formed by compressing a stack of generally circular buffing pads along a central axis. The individual pads have a generally wave-like outer peripheral surface having valleys and mounds. When compressed together, the mounds form small knobs that are ideal for buffing or cleaning intricate surfaces.

5 Claims, 2 Drawing Sheets

BUFFING BALL

BACKGROUND OF THE INVENTION

Buffing balls are formed from compressed pads of a buffing material. The pads are compressed on a drive post of a buffing apparatus or drill. Buffing balls are used to clean and polish various surfaces.

Generally, these buffing balls are formed from circular disks. Some of these buffing balls are formed with disks that have radial slits through the peripheral surface to form a plurality of segmented portions along the edge of the buffing pad. This creates a somewhat irregular surface. However, the individual segments tend to break off.

SUMMARY OF THE INVENTION

The present invention is premised on the realization that a buffing ball that is particularly suited for cleaning or polishing various contoured surfaces and crevices can be formed from compressed buffing pads wherein the peripheral edge of the buffing pad has a wave-like configuration. This forms mounds and valleys along the edges of the buffing surface. When the pads are compressed, these mounds form arcuate knobs that are particularly suited for cleaning intricate surfaces. Further, due to the edge formation, the formed knobs on the buffing ball do not tend to tear or break off. This, in turn, makes the buffing ball last longer.

The objects and advantages of the present invention will be further appreciated in light of the following detailed description and drawings in which:

DETAILED DESCRIPTION

Figure 2:
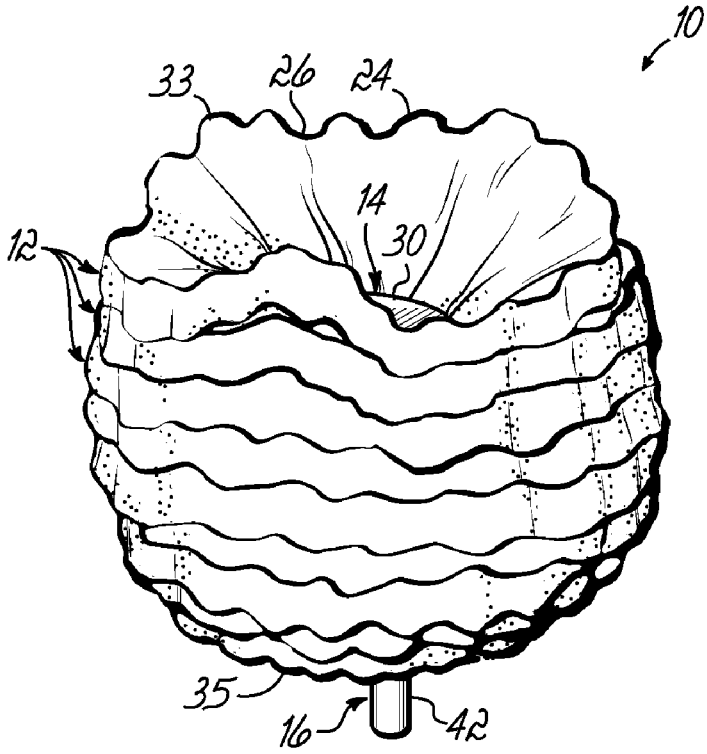
FIG. 2 is an assembled view of the present invention.
Figure 3:
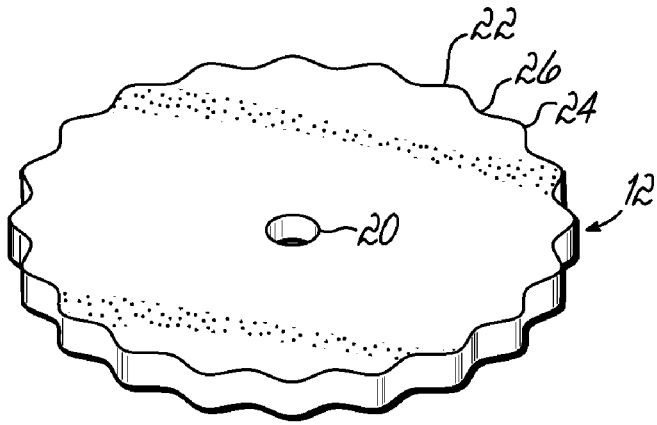
FIG. 3 is a perspective view of a single pad used in the present invention.

As shown in FIG. 2, the present invention is a buffing ball 10, which is formed from a plurality of pads 12 compressed together between a bolt 14 and a drive post 16 with the bolt extending through a central hole 20 in each of the pads 12. As shown in FIG. 3, each pad 12 is a generally circular disk with a peripheral edge 22 having raised portions 24, also referred to as mounds, and recessed portions 26, also referred to as valley portions, separating adjacent mounds 24. This provides an undulating or generally sinusoidal peripheral edge. Each pad 12 includes a central opening 20.

The pads 12 are cut from a buffing material. Buffing material is formed from polymeric fibers such as nylon formed into a nonwoven web. The material can incorporate an abrasive materials such as aluminum oxide. This material is similar in consistency to a scouring pad.

Generally, the thickness of the individual pads 12 will vary from about ⅛ to ¾ inch, with a ¼-inch thick pad in a non-compressed state functioning well. The diameter of the pad 12 from the tip of one mound 24 to the tip of an opposite mound 24 should range from about 3 to about 6 inches or more, with a pad of about 4 inches in diameter functioning quite well.

Figure 1:
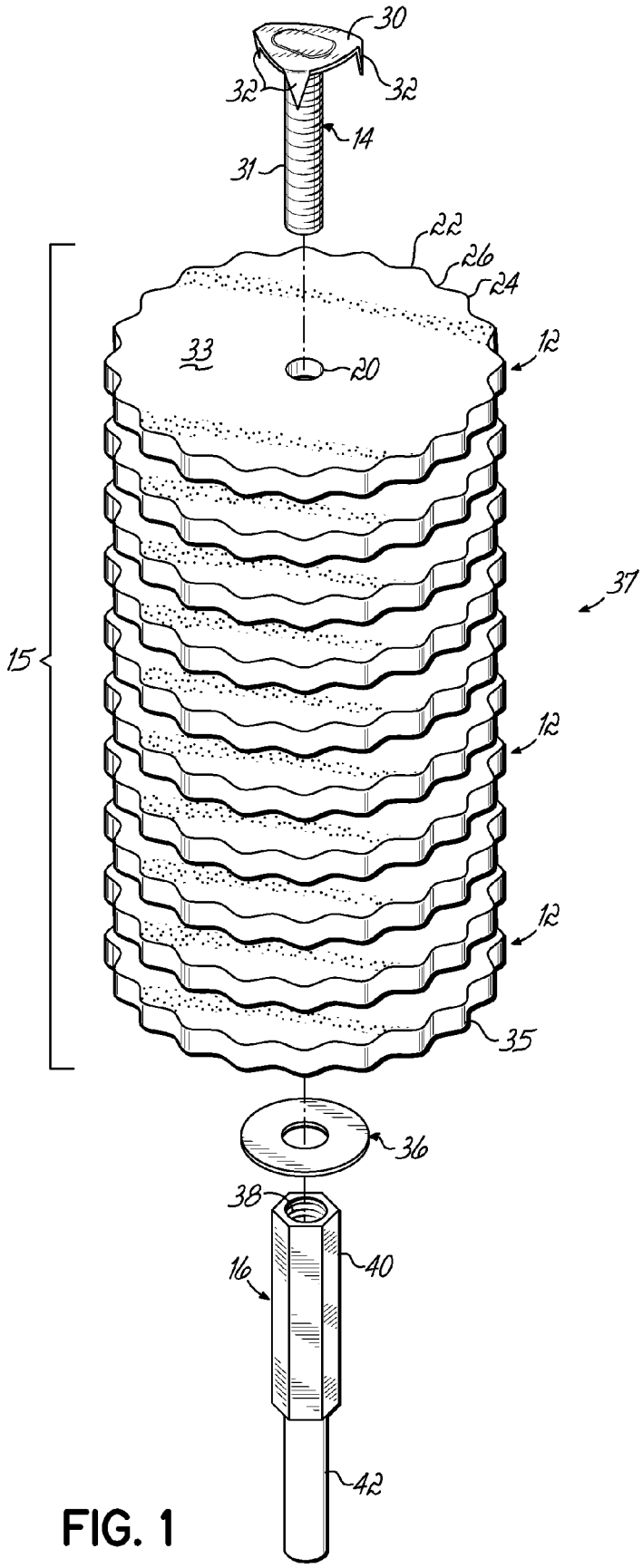
FIG. 1 is an exploded view of the present invention.

The number of pads 12 is a matter of choice. As shown in FIG. 1, 10 pads are employed. The number of pads can be reduced to as low as 5, and increased to 15 or more, if desired. This is simply a matter of choice.

The buffing ball 10 is formed by compressing the assembled stack 15 of pads 12 between the drive post 16 of the drill or buffing apparatus and the head 30 of a bolt 14. The head 30 further includes three teeth 32 which are designed to dig into the surface of the topmost pad 33. Externally threaded post 31 of bolt 14 extends through the central holes 20 of the pads 12, and extends through a washer 36 and into an internally threaded portion 38 of drive post 16.

As shown, drive post 16 has a hexagonally shaped portion 40 and a cylindrical post portion 42. The hexagonal portion allows one to grab the drive post 16 with a wrench or a pliers to rotate it, and tightening it on the externally threaded post 31 of bolt 14 thereby drawing top most pad 33 toward the bottom pad 35 and compressing the stack 15 of pads 12 together to form ball 10, as shown in FIG. 2. As shown, the top pad 33 and bottom pad 35 flare upwardly and downwardly, respectively, with the central pads 37 extending laterally outwardly without flexing upwardly or downwardly. Thus, the buffing ball 10 assumes a generally cylindrical shape with a plurality of mounds or knobs 24 around the periphery of the ball 10.

The drive post 16 attaches to a drill or a buffing apparatus, which rotates the buffing ball 10 at high speeds. The peripheral surface of the buffing ball 10 is pressed against the surface of an object being cleaned or buffed. The individual knobs 24 engage smaller crevices, and the like, along the surface of the object being polished. Due to the fact that is has the generally sinusoidal peripheral edge, the knobs will not tend to break off. The irregular surface of the ball 10 also assists in cleaning and buffing even smooth surfaces.

This has been a description of the present invention along with the preferred method of practicing the present invention. However, the invention itself should only be defined by the appended claims.

What is claimed is:

1. A buffing ball comprising a plurality of buffing pads compressed along a central opening to form a ball shape;

said pads having a peripheral edge having a generally wave-like configuration, said edge comprising a series of radially raised portions separated by radial valley portions; and wherein the peripheral edge of said raised portions is outwardly curved and the peripheral edge of said valley portions is inwardly curved.

2. The buffing ball claimed in claim 1 wherein said pads are formed of a thick nonwoven fibrous web.

3. The buffing ball claimed in claim 2 wherein said pads have a thickness of 0.125 to 0.75 inches.

4. The buffing ball claimed in claim 2 wherein said pads are compressed together by a bolt screwed into a hollow drive post.

5. The buffing ball claimed in claim 1 wherein said buffing ball has from about 5 to about 15 pads.

* * * * *